US011913103B2

(12) United States Patent
Takeuchi et al.

(10) Patent No.: US 11,913,103 B2
(45) Date of Patent: Feb. 27, 2024

(54) COPPER ALLOY

(71) Applicant: NGK INSULATORS, LTD., Nagoya (JP)

(72) Inventors: Ryota Takeuchi, Tokai (JP); Takanori Asano, Kuki (JP)

(73) Assignee: NGK INSULATORS, LTD., Nagoya (JP)

( * ) Notice: Subject to any disclaimer, the term of this patent is extended or adjusted under 35 U.S.C. 154(b) by 0 days.

(21) Appl. No.: 17/660,855

(22) Filed: Apr. 27, 2022

(65) Prior Publication Data

US 2022/0389541 A1 Dec. 8, 2022

(30) Foreign Application Priority Data

May 27, 2021 (JP) ..... 2021-088970

(51) Int. Cl.
*C22C 9/06* (2006.01)

(52) U.S. Cl.
CPC ..... *C22C 9/06* (2013.01)

(58) Field of Classification Search
CPC ..... C22C 9/02; C22C 9/06; C22F 1/08
USPC ..... 420/473
See application file for complete search history.

(56) References Cited

U.S. PATENT DOCUMENTS 3,937,638 A 2/1976 Plewes
5,089,057 A * 2/1992 Plewes ..... C22F 1/08 148/412
6,478,902 B2 * 11/2002 Koenigsmann ..... C23C 14/3414 148/681

FOREIGN PATENT DOCUMENTS

CN 108453222 A 8/2018
EP 3 006 588 B1 7/2018
JP S63-317636 A 12/1988
JP 6324431 B2 5/2018

OTHER PUBLICATIONS

NPL-1: Chao et all, Cu—Ni—Sn alloy fabricated by melt spinning and selected laser melting: a comparative study on the microstructure and formation kinetics, J. Matt. Res. Technol. 2020 9(6) pp. 13097-13105, (Year: 2020).*
Extended European Search Report, European Application No. 22172848.8, dated Sep. 27, 2022 (9 pages).

* cited by examiner

*Primary Examiner* — Jie Yang
(74) *Attorney, Agent, or Firm* — BURR PATENT LAW, PLLC

(57) ABSTRACT

There is provided a copper alloy consisting of: Ni: 10 to 15% by weight, Sn: 5.0% by weight or more, Mn: 0 to 0.5% by weight, Zr: 0 to 0.5% by weight, at least one selected from the group consisting of Nb, Fe, Al, Ti, B, Zn, Si, Co, P, Mg, and Bi: 0 to 0.2% by weight in total, and the balance being Cu and inevitable impurities. The copper alloy has, in an X-ray diffraction profile, (i) a peak in the vicinity of 2θ=46 to 50° having a peak intensity of 30% or more with respect to a peak intensity in the vicinity of 2θ=84 to 88° and (ii) a peak in the vicinity of 2θ=40 to 42° having a peak intensity of 2.0% or more with respect to a peak intensity in the vicinity of 2θ=84 to 88°.

5 Claims, 3 Drawing Sheets

COPPER ALLOY

CROSS-REFERENCE TO RELATED APPLICATION

This application claims priority to Japanese Patent Application No. 2021-088970 filed May 27, 2021, the entire content of which is incorporated herein by reference.

BACKGROUND OF THE INVENTION

1. Field of the Invention

The present invention relates to a copper alloy.

2. Description of the Related Art

Generally, semiconductor devices such as an integrated circuit (IC) or an LSI are subjected to a performance check at high temperature, that is, a burn-in test, in order to improve their reliability. In this test, since the device is operated at high temperature, its performance can be evaluated under a condition close to an actual usage state. Therefore, since burn-in sockets used at this time are used for an energization application under a high load stress, they are placed in a severe environment.

Beryllium copper has been conventionally used for burn-in sockets as a material having both high strength and high electrical conductivity. However, beryllium copper had some defects such as a significant decrease in stress relaxation characteristics at high temperatures of 180° C. or higher, and was therefore insufficient for using for an energization application under a high load stress. On the other hand, a Cu—Ni—Sn alloy is known as a copper alloy having excellent stress relaxation characteristics at high temperature.

Patent Literature 1 (JPS63-317636A) discloses a copper alloy for burn-in IC sockets of a semiconductor device characterized by including Ni: 5 to 30 wt %, Sn: 3 to 10 wt %, Mn: 0.01 to 2 wt %, and the balance being Cu and inevitable impurities. It is stated that as to this copper alloy, a stress relaxation rate is evaluated under a condition of a load stress of 30 kgf/m$^2$ and a load temperature of 150° C., and the copper alloy can extend the life of the burn-in IC sockets.

CITATION LIST

Patent Literature

Patent Literature 1: JPS63-317636A

SUMMARY OF THE INVENTION

However, the test conditions as disclosed in Patent Literature 1 are not as severe as the conditions for an energization application under a high load stress of burn-in sockets and the like, and the characteristics of the copper alloy disclosed in the document are insufficient. Therefore, a copper alloy having excellent characteristics under a severer condition close to the actual usage environment is required.

The present inventors have recently found that a copper alloy having a predetermined composition and having a predetermined X-ray diffraction profile when determined by an X-ray diffraction method (XRD) has excellent tensile strength, electrical conductivity, and stress relaxation characteristics at high temperature of about 200° C.

Therefore, an object of the present invention is to provide a copper alloy excellent in tensile strength, electrical conductivity, and stress relaxation characteristics at high temperature of about 200° C.

According to an aspect of the present invention, there is provided a copper alloy consisting of:

Ni: 10 to 15% by weight;

Sn: 5.0% by weight or more;

Mn: 0 to 0.5% by weight;

Zr: 0 to 0.5% by weight; and at least one selected from the group consisting of Nb, Fe, Al, Ti, B, Zn, Si, Co, P, Mg, and Bi: 0 to 0.2% by weight in total;

the balance being Cu and inevitable impurities, wherein, in an X-ray diffraction profile determined by an X-ray diffraction method (XRD), the copper alloy has:

(i) a peak in the vicinity of 2θ=46 to 50° having a peak intensity of 30% or more with respect to a peak intensity in the vicinity of 2θ=84 to 88° and (ii) a peak in the vicinity of 2θ=40 to 42° having a peak intensity of 2.0% or more with respect to a peak intensity in the vicinity of 2θ=84 to 88°.

DETAILED DESCRIPTION OF THE INVENTION

Copper Alloy

Figure 1:
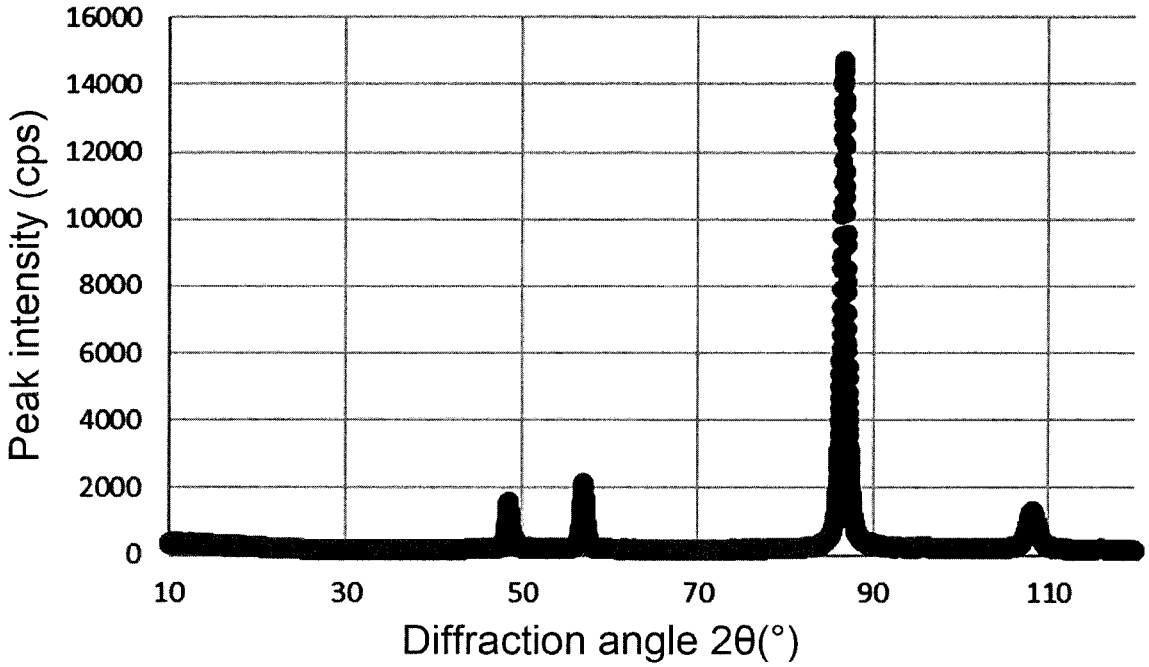
FIG. 1 is an X-ray diffraction profile of a copper alloy obtained in Example 1.

A copper alloy according to the present invention consists of Ni: 10 to 15% by weight, Sn: 5.0% by weight or more, Mn: 0 to 0.5% by weight, Zr: 0 to 0.5% by weight, at least one selected from the group consisting of Nb, Fe, Al, Ti, B, Zn, Si, Co, P, Mg, and Bi: 0 to 0.2% by weight in total, and the balance being Cu and inevitable impurities. Then, in the X-ray diffraction profile determined by the X-ray diffraction method (XRD), this copper alloy has (i) a peak in the vicinity of 2θ=46 to 50° having a peak intensity of 30% or more with respect to a peak intensity in the vicinity of 2θ=84 to 88° and (ii) a peak in the vicinity of 2θ=40 to 42° having a peak intensity of 2.0% or more with respect to a peak intensity in the vicinity of 2θ=84 to 88°. Such a copper alloy is excellent in tensile strength, electrical conductivity, and stress relaxation characteristics at high temperature of about 200° C. As described above, when the copper alloy used for an energization application under high load stress of burn-in sockets and the like is placed in a severe environment, the characteristics of conventional copper alloys are insufficient. On the other hand, according to the present invention, such a problem is conveniently solved.

A copper alloy of the present invention consists of Ni: 10 to 15% by weight, Sn: 5.0% by weight or more, Mn: 0 to 0.5% by weight, Zr: 0 to 0.5% by weight, at least one selected from the group consisting of Nb, Fe, Al, Ti, B, Zn, Si, Co, P, Mg, and Bi (hereinafter, referred to as an arbitrary element M): 0 to 0.2% by weight in total, and the balance being Cu and inevitable impurities. The copper alloy preferably consists of Ni: 11 to 14% by weight, Sn: 5.0 to 8.0% by weight, Mn: 0 to 0.5% by weight, Zr: 0 to 0.5% by weight, an arbitrary element M: 0 to 0.2% by weight in total, and the balance being Cu and inevitable impurities, and more preferably consists of Ni: 11 to 13% by weight, Sn: 6.5 to 7.5% by weight, Mn: 0 to 0.5% by weight, Zr: 0 to 0.5% by weight, an arbitrary element M: 0 to 0.2% by weight in total, and the balance being Cu and inevitable impurities. Therefore, the Ni content in the copper alloy is 10 to 15% by weight, preferably 11 to 14% by weight, and more preferably 11 to 13% by weight. The Sn content in the copper alloy is 5.0% by weight or more, preferably 5.0 to 8.0% by weight, and more preferably 6.5 to 7.5% by weight. As described above, when the Ni content in the copper alloy is 10% by weight or more, excellent heat resistance characteristics (for example, stress relaxation characteristics) can be maintained even at high temperature (for example, 200° C.). In addition, when the Ni content is 15% by weight or less, excellent electrical conductivity can be maintained. Further, when the Sn content in the copper alloy is 5.0% by weight or more, excellent tensile strength can be maintained.

In the X-ray diffraction profile determined by the X-ray diffraction method (XRD), a copper alloy of the present invention, has (i) a peak in the vicinity of 2θ=46 to 50° having a peak intensity of 30% or more with respect to a peak intensity in the vicinity of 2θ=84 to 88° and (ii) a peak in the vicinity of 2θ=40 to 42° having a peak intensity of 2.0% or more with respect to a peak intensity in the vicinity of 2θ=84 to 88°. In (i), the peak intensity in the vicinity of 2θ=46 to 50° is preferably 35 to 80% and more preferably 40 to 70% with respect to the peak intensity in the vicinity of 2θ=84 to 88°. In (ii), the peak intensity in the vicinity of 2θ=40 to 42° is preferably 2.5 to 10.0% and more preferably 3.0 to 8.0% with respect to the peak intensity in the vicinity of 2θ=84 to 88°. Further, this copper alloy has preferably a peak in the vicinity of 2θ=55 to 57° having a peak intensity of 7.0% or less with respect to a peak intensity in the vicinity of 2θ=84 to 88°, and the ratio of this peak intensity is more preferably 6.0% or less.

The copper alloy of the present invention preferably has a tensile strength (Ts) of 1200 MPa or more and more preferably 1250 MPa or more. Since the tensile strength is preferably high, the upper limit thereof is not particularly limited, but is typically 1400 MPa or less.

The copper alloy of the present invention preferably has an electrical conductivity of 10% IACS or higher and more preferably 11% IACS or higher. Since the electrical conductivity is preferably high, the upper limit thereof is not particularly limited, but is typically 20% IACS or less. Here, a unit of electrical conductivity, "% IACS", represents a ratio of the electrical conductivity of a test piece assuming the electrical conductivity of IACS (International Annealed Copper Standard) as 100%.

The copper alloy of the present invention preferably has a stress relaxation rate of less than 15% and more preferably 13% or less, after being loaded with a stress of 900 MPa for 1000 hours at high temperature of 200° C. This stress relaxation rate is preferably low (ideally 0%), and the lower limit thereof is not particularly limited, but is typically 5.0% or more.

Production Method of Copper Alloy

A method for producing a copper alloy according to the present invention is not particularly limited, but for example, includes the steps of: (a) melting and casting a raw material alloy consisting of Ni: 10 to 15% by weight, Sn: 5.0% by weight or more, Mn: 0 to 0.5% by weight, Zr: 0 to 0.5% by weight, at least one selected from the group consisting of Nb, Fe, Al, Ti, B, Zn, Si, Co, P, Mg, and Bi: 0 to 0.2% by weight in total, and the balance being Cu and inevitable impurities, to make an ingot, (b) subjecting the ingot to a hot working and/or cold working to make an intermediate product, (c) performing a thermomechanical treatment by subjecting the intermediate product to i) a heat treatment, ii) a hot working and/or cold working, and iii) a solution annealing in this order, and (d) performing an aging treatment of the intermediate product after the thermomechanical treatment to obtain a copper alloy. Since the preferred aspect of the copper alloy is as described above, the description thereof is omitted here.

(a) Melting and Casting of Raw Material Alloy

First, a raw material alloy is prepared. The raw material alloy preferably consists of Ni: 10 to 15% by weight, Sn: 5.0% by weight or more, Mn: 0 to 0.5% by weight, Zr: 0 to 0.5% by weight, at least one selected from the group consisting of Nb, Fe, Al, Ti, B, Zn, Si, Co, P, Mg, and Bi (hereinafter, referred to as an arbitrary element M): 0 to 0.2% by weight in total, and the balance being Cu and inevitable impurities, more preferably consists of Ni: 11 to 14% by weight, Sn: 5.0 to 8.0% by weight, Mn: 0 to 0.5% by weight, Zr: 0 to 0.5% by weight, an arbitrary element M: 0 to 0.2% by weight in total, and the balance being Cu and inevitable impurities, and still more preferably consists of Ni: 11 to 13% by weight, Sn: 6.5 to 7.5% by weight, Mn: 0 to 0.5% by weight, Zr: 0 to 0.5% by weight, an arbitrary element M: 0 to 0.2% by weight in total, and the balance being Cu and inevitable impurities. Therefore, the Ni content is 10 to 15% by weight, preferably 11 to 14% by weight, and more preferably 11 to 13% by weight in the raw material alloy. The Sn content is 5.0% by weight or more, preferably 5.0 to 8.0% by weight, and more preferably 6.5 to 7.5% by weight in the raw material alloy.

In this step, the prepared raw material alloy is melted and cast to make an ingot. The raw material alloy is preferably melted in, for example, a high frequency melting furnace. The casting method is not particularly limited, but a method such as a full continuous casting method, a semi-continuous casting method, and a batch casting method may be used. Further, a method such as a horizontal casting method and a vertical casting method may be used. The shape of the resultant ingot may be, for example, a slab, a billet, a bloom, a plate, a rod, a pipe, a block, or the like, but is not particularly limited thereto and so any shape may be used other than these.

(b) Hot Working and/or Cold Working of Ingot

The resultant ingot is subjected to a hot working and/or cold working to make an intermediate product. Examples of the working method include forging, rolling, extrusion, and drawing. In this step, the ingot is preferably roughly rolled by the hot working and/or cold working to obtain a rolled material (intermediate product).

(c) Thermomechanical Treatment

A thermomechanical treatment is performed by subjecting the resultant intermediate product to i) a heat treatment, ii) a hot working and/or cold working, and iii) a solution annealing in this order.

In the step of performing the thermomechanical treatment, first, the intermediate product is subjected to a heat treatment. This heat treatment is preferably held at 500 to 950° C. for 1 to 24 hours. The temperature of the heat treatment is more preferably 600 to 800° C. and still more preferably 650 to 750° C. The holding time at the above temperature is more preferably 1 to 12 hours and still more preferably 5 to 10 hours.

After subjecting the intermediate product to the heat treatment, a hot working and/or cold working are performed. As the processing method, the same method as the method in the above (b) may be used.

A solution annealing is subjected to the intermediate product after the hot working and/or cold working. This treatment is preferably held at 700 to 1000° C. for 5 seconds to 24 hours. The temperature of the solution annealing is more preferably 800 to 950° C. The holding time at the above temperature is more preferably 1 minute to 5 hours. A cooling method is not particularly limited, and examples thereof include water cooling, gas cooling, oil cooling, and air cooling. The temperature dropping rate due to this cooling is preferably 20° C./s or higher and more preferably 50° C./s or higher.

(d) Aging Treatment of Intermediate Product

The intermediate product after the thermomechanical treatment is subjected to an aging treatment to obtain a copper alloy. The aging treatment allows the strength of the resultant copper alloy to be increased. The temperature of the aging treatment is preferably 300 to 500° C. and more preferably 350 to 450° C. The holding time at the above temperature is preferably 1 to 24 hours and more preferably 2 to 12 hours.

By undergoing through the above steps (a) to (d), the copper alloy having excellent tensile strength, electrical conductivity, and stress relaxation characteristics at high temperature of about 200° C. can be preferably produced.

Further, the intermediate product may be subjected to a finish-hot working or finish-cold working after the thermomechanical treatment of the above (c) and before the aging treatment of the above (d). That is, it is preferable to further include a step of subjecting the intermediate product to the finish-hot working or finish-cold working after the thermomechanical treatment and before the aging treatment. By doing so, the intermediate product having a targeted plate thickness can be produced. At this time, for example, when the intermediate product is subjected to finish rolling to made into a plate shape, it is preferable to roll it so that a finish working ratio (draft) defined by the following formula: $P=100\times(T-t)/T$, wherein P is a finish working ratio (%), T is a plate thickness (mm) of the intermediate product before finish rolling, and t is a plate thickness (mm) of the intermediate product after finish rolling, is 40% or more. This can improve the strength of the copper alloy that is finally obtained.

EXAMPLES

The present invention will be more specifically described with reference to the following examples.

Example 1 (Comparison)

A copper alloy was produced by the following procedures and evaluated.

(1) Melting and casting of raw material alloy A raw material alloy (Ni: 9.1% by weight, Sn: 5.9% by weight, Mn: 0 to 0.5% by weight, Zr: 0 to 0.5% by weight, and the balance being Cu and inevitable impurities) was prepared. This raw material alloy was melted in a high frequency melting furnace and cast by a vertical casting method to obtain a round ingot having a diameter of 320 mm.

(2) Hot Working or Cold Working of Ingot

The resultant ingot was subjected to a soaking treatment, and then the hot working and cold working, thereby obtaining an intermediate product.

(3) Thermomechanical Treatment

The resultant intermediate product was subjected to the heat treatment. Specifically, the intermediate product was held at 700° C. for 6 hours. Next, this intermediate product was rolled by the cold working so that the working ratio was 50%, and the intermediate product was made into a plate shape. Further, this intermediate product was subjected to the solution annealing by heating at 850° C. for 60 seconds, and immediately after that, the resultant was rapidly cooled by water cooling at a temperature dropping rate of 50° C./s or more. By doing so, the intermediate product was subjected to the thermomechanical treatment.

(4) Finish-Hot Working or Finish-Cold Working of Intermediate Product

The thickness of the intermediate product was made to 0.2 mm by cold rolling (finish rolling) of the intermediate product subjected to the thermomechanical treatment.

(5) Aging Treatment of Intermediate Product

The intermediate product subjected to finish rolling was held at 415° C. for 2 hours, thereby subjecting the intermediate product to the aging treatment to obtain a copper alloy.

(6) Evaluation

The following evaluations were performed on the resultant copper alloy.

<Tensile Strength>

The tensile strength (MPa) of the copper alloy obtained in the above (5) was measured in accordance with JIS Z2241: 2011. The results were as shown in Table 1.

<Electrical Conductivity>

The electrical conductivity (% IACS) of the copper alloy obtained in the above (5) was measured by a four-terminal method using a double bridge in accordance with JIS H0505:1975. The results were as shown in Table 1.

<Stress Relaxation Rate>

The stress relaxation rate (%) of the copper alloy obtained in the above (5) was measured after loading a stress of 900 MPa at 200° C. for 1000 hours in accordance with JCBA T309:2004. The results were as shown in Table 1.

<XRD>

On a surface of the copper alloy obtained in the above (5), an oxide film was removed to make a smooth surface without foreign substances. This surface was subjected to X-ray diffraction (XRD) to acquire an X-ray diffraction profile. This XRD was performed using an XRD device (manufactured by Bruker AXS, product name: D2 PHASER) under conditions of X-rays used: Co-Kα rays, voltage: 30 kV, current: 10 mA, and 2θ=10 to 120° and under a condition of step width: 0.02°. The resultant X-ray diffraction profile is shown in FIG. 1. In the X-ray diffraction profile, a peak in the vicinity of 2θ=40 to 42°, a peak in the vicinity of 2θ=46 to 50°, a peak in the vicinity of 2θ=55 to 57°, a peak in the vicinity of 2θ=84 to 88°, and a peak in the vicinity of 2θ=105 to 110° were identified and their peak intensities were determined. Then, the ratio of the other peak intensity to the peak intensity in the vicinity of 2θ=84 to 88° was obtained for each peak position. The results were as shown in Tables 1 and 2.

<Comprehensive Evaluation>

The tensile strength, electrical conductivity, and stress relaxation rate measured in the copper alloy were comprehensively evaluated (judged) according to the following criteria. The results were as shown in Table 1.

Pass: Tensile strength of 1200 MPa or more, electrical conductivity of 10% IACS or more, and stress relaxation rate of less than 15%

Fail: Those outside the numerical range of "Pass"

Example 2

Figure 2:
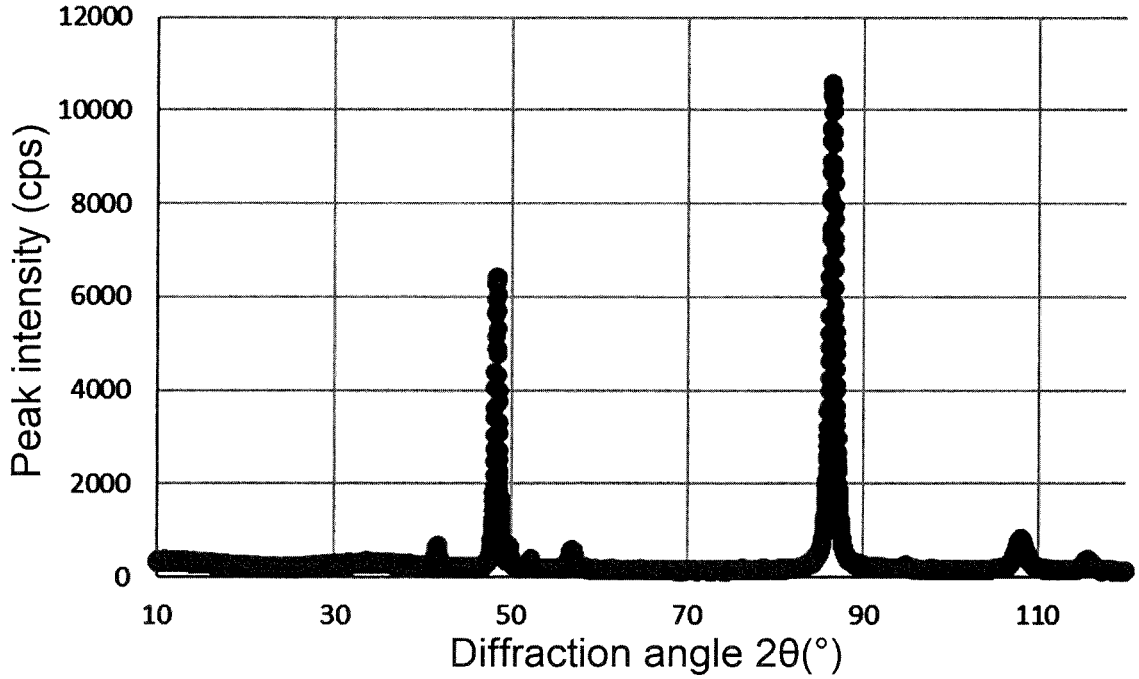
FIG. 2 is an X-ray diffraction profile of a copper alloy obtained in Example 2.

A copper alloy was produced and evaluated in the same way as in Example 1 except that using a raw material alloy having a composition including Ni: 11.2% by weight, Sn: 7.1% by weight, Mn: 0 to 0.5% by weight, Zr: 0 to 0.5% by weight, and the balance being Cu and inevitable impurities as the raw material alloy in the above (1). The results were as shown in Tables 1 and 2. Also, the X-ray diffraction profile of this copper alloy is shown in FIG. 2.

Example 3

Figure 3:
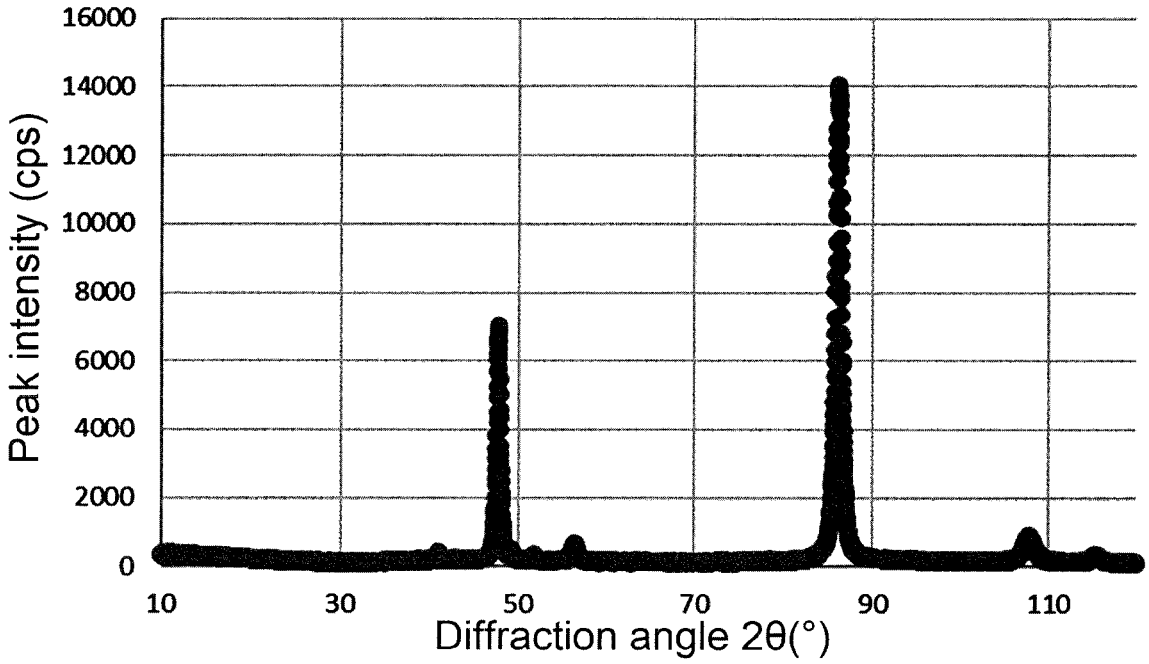
FIG. 3 is an X-ray diffraction profile of a copper alloy obtained in Example 3.

A copper alloy was produced and evaluated in the same way as in Example 1 except that using a raw material alloy having a composition including Ni: 12.1% by weight, Sn: 6.9% by weight, Mn: 0 to 0.5% by weight, Zr: 0 to 0.5% by weight, and the balance being Cu and inevitable impurities as the raw material alloy in the above (1). The results were as shown in Tables 1 and 2. Also, the X-ray diffraction profile of this copper alloy is shown in FIG. 3.

Example 4 (Comparison)

Figure 4:
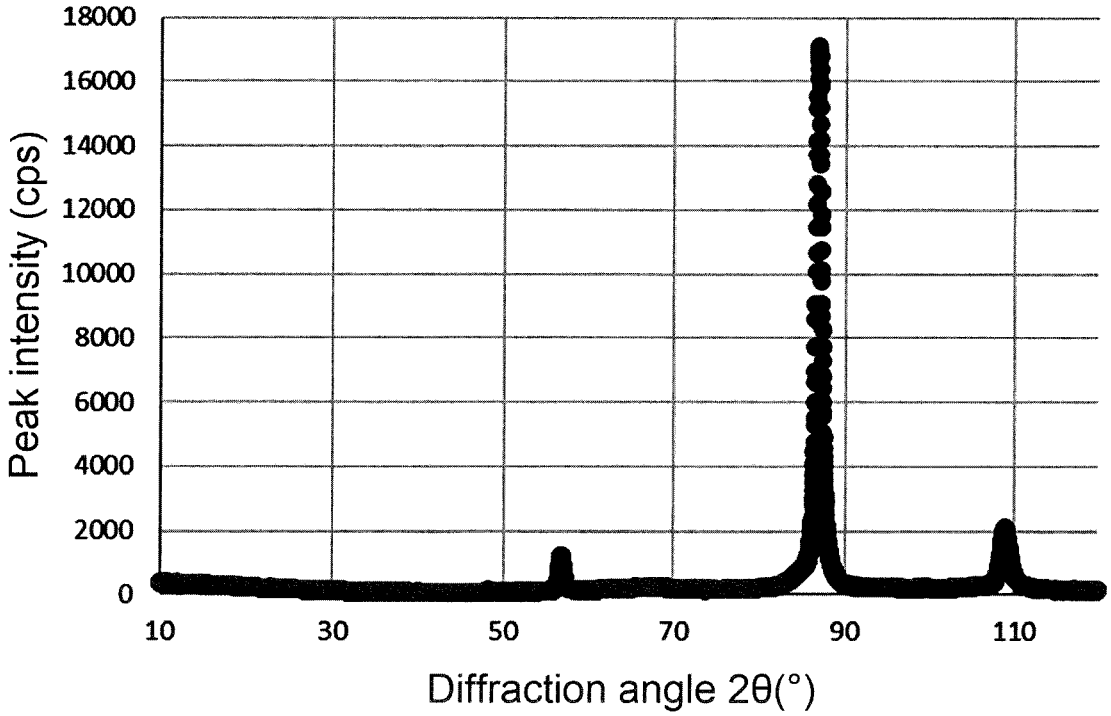
FIG. 4 is an X-ray diffraction profile of a copper alloy obtained in Example 4.

A copper alloy was produced and evaluated in the same way as in Example 1 except that using a raw material alloy having a composition including Ni: 15.3% by weight, Sn: 8.1% by weight, Mn: 0 to 0.5% by weight, Zr: 0 to 0.5% by weight, and the balance being Cu and inevitable impurities as the raw material alloy in the above (1). The results were as shown in Tables 1 and 2. Also, the X-ray diffraction profile of this copper alloy is shown in FIG. 4.

Example 5 (Comparison)

Figure 5:
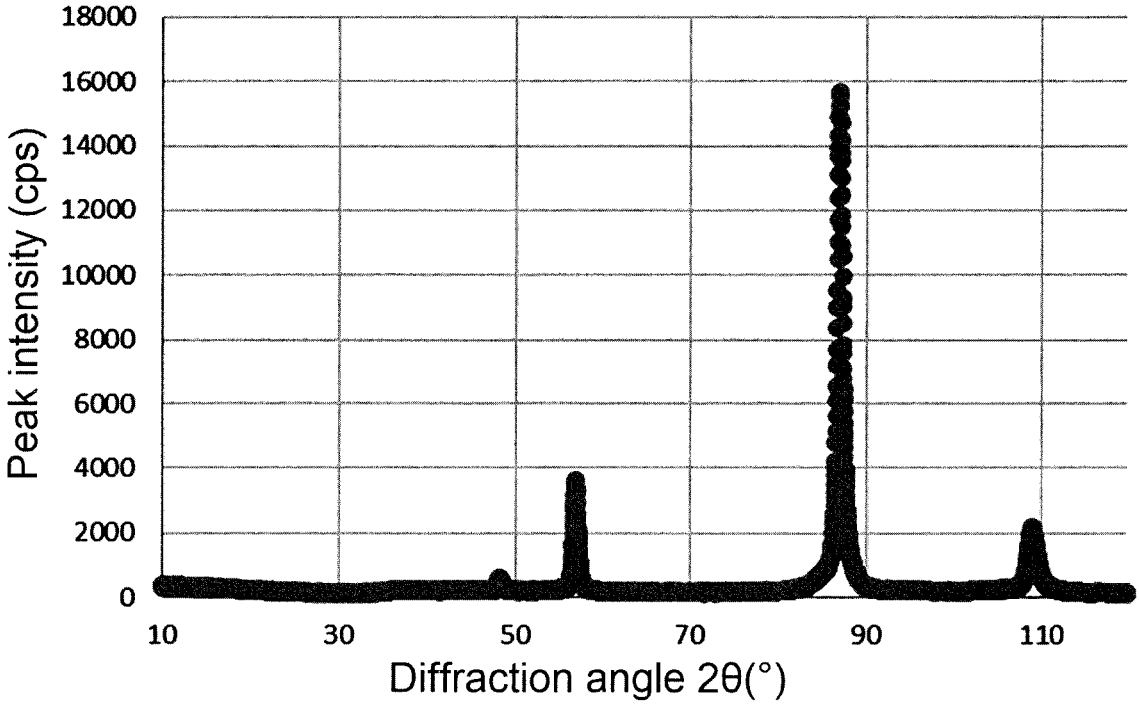
FIG. 5 is an X-ray diffraction profile of a copper alloy obtained in Example 5.

A copper alloy was produced and evaluated in the same way as in Example 1 except that using a raw material alloy having a composition including Ni: 21.1% by weight, Sn: 4.9% by weight, Mn: 0 to 0.5% by weight, Zr: 0 to 0.5% by weight, and the balance being Cu and inevitable impurities as the raw material alloy in the above (1). The results were as shown in Tables 1 and 2. Also, the X-ray diffraction profile of this copper alloy is shown in FIG. 5.

TABLE 1

| | Content of each element (% by weight) | | XRD Ratio of a peak intensity in the vicinity of each diffraction angle 2θ with respect to a peak intensity in the vicinity of 2θ = 84 to 88° (%) | | | | | Tensile strength | Electrical conductivity | Stress relaxation | |
|---|---|---|---|---|---|---|---|---|---|---|---|
| | Ni | Sn | 40-42° | 46-50° | 55-57° | 84-88° | 105-110° | (MPa) | (% IACS) | rate (%) | Judgement |
| Example 1* | 9.1 | 5.9 | 1.3 | 10.9 | 14.1 | 100.0 | 8.9 | 1121 | 12.2 | 21 | Fail |
| Example 2 | 11.2 | 7.1 | 6.7 | 60.7 | 5.7 | 100.0 | 8.0 | 1261 | 11.6 | 12.3 | Pass |
| Example 3 | 12.1 | 6.9 | 3.0 | 49.9 | 4.7 | 100.0 | 6.6 | 1276 | 11.2 | 11.4 | Pass |
| Example 4* | 15.3 | 8.1 | 0.5 | 0.8 | 7.1 | 100.0 | 12.4 | 1266 | 7.5 | 9.1 | Fail |
| Example 5* | 21.1 | 4.9 | 1.5 | 3.8 | 23.0 | 100.0 | 13.9 | 1194 | 7.3 | 5.4 | Fail |

*indicates a comparative example.

TABLE 2

| | Content of each element (% by weight) | | XRD Peak intensity in the vicinity of each diffraction angle 2θ(°) (cps) | | | | |
|---|---|---|---|---|---|---|---|
| | Ni | Sn | 40-42° | 46-50° | 55-57° | 84-88° | 105-110° |
| Example 1* | 9.1 | 5.9 | 188 | 1609 | 2071 | 14736 | 1313 |
| Example 2 | 11.2 | 7.1 | 710 | 6429 | 608 | 10596 | 846 |
| Example 3 | 12.1 | 6.9 | 418 | 7027 | 666 | 14071 | 923 |
| Example 4* | 15.3 | 8.1 | 89 | 142 | 1220 | 17118 | 2117 |
| Example 5* | 21.1 | 4.9 | 242 | 600 | 3609 | 15667 | 2171 |

*indicates a comparative example.

What is claimed is:

1. A copper alloy consisting of:

Ni: 10 to 15% by weight;

Sn: 5.0 to 8% by weight;

Mn: 0 to 0.5% by weight;

Zr: 0 to 0.5% by weight;

at least one selected from the group consisting of Nb, Fe, Al, Ti, B, Zn, Si, Co, P, Mg, and Bi: 0 to 0.2% by weight in total; and the balance being Cu and inevitable impurities, wherein, in an X-ray diffraction profile determined by an X-ray diffraction method (XRD), the copper alloy has:

(i) a peak in the vicinity of 2θ=46 to 50° having a peak intensity of 30% or more with respect to a peak intensity in the vicinity of 2θ=84 to 88°, (ii) a peak in the vicinity of 2θ=40 to 42° having a peak intensity of 2.0% or more with respect to a peak intensity in the vicinity of 2θ=84 to 88°, and (iii) a peak in the vicinity of 2θ=55 to 57° having a peak intensity of 7.0% or less with respect to a peak intensity in the vicinity of 2θ=84 to 88°, and wherein the copper alloy has a tensile strength of 1200 MPa or more.

2. The copper alloy according to claim 1, wherein a Ni content is 11 to 14% by weight and a Sn content is 5.0 to 8.0% by weight.

3. The copper alloy according to claim 2, wherein the Ni content is 11 to 13% by weight and the Sn content is 6.5 to 7.5% by weight.

4. The copper alloy according to claim 1, wherein the copper alloy has an electrical conductivity of 10% IACS (International Annealed Copper Standard) or more.

5. A copper alloy consisting of:

Ni: 10 to 15% by weight;

Sn: 5.0 to 8% by weight;

Mn: 0 to 0.5% by weight;

Zr: 0 to 0.5% by weight;

at least one selected from the group consisting of Nb, Fe, Al, Ti, B, Zn, Si, Co, P, Mg, and Bi: 0 to 0.2% by weight in total; and the balance being Cu and inevitable impurities, wherein, in an X-ray diffraction profile determined by an X-ray diffraction method (XRD), the copper alloy has:

(i) a peak in the vicinity of 2θ=46 to 50° baying a peat intensity of 30% or more with respect to a peak intensity in the vicinity of 2θ=84 to 88°, (ii) a peak in the vicinity of 2θ=40 to 42° having a peak intensity of 2.0% or more with respect to a peak intensity in the vicinity of 2θ=84 to 88°, and (iii) a peak in the vicinity of 2θ=55 to 57° had in peak intensity of 7.0% or less with respect to a peak intensity in the vicinity of 2θ=84 to 88°, and wherein the copper alloy has a stress relaxation rate of less than 15% after loading a stress of 900 MPa at high temperature of 200° C. for 1000 hours.

* * * * *